US006461194B2

(12) United States Patent
Katoh et al.

(10) Patent No.: US 6,461,194 B2
(45) **Date of Patent: *Oct. 8, 2002**

(54) CONNECTOR HAVING A SHIELD FOR SIGNAL CONTACTS

(75) Inventors: Satoshi Katoh, Tokyo (JP); Tadashi Kumamoto, Tokyo (JP); Takeshi Okuyama, Tokyo (JP); Hideo Miyazawa, Tokyo (JP); Yukihiro Maitani, Tokyo (JP)

(73) Assignee: Fujitsu Takamisawa Component Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/418,975

(22) Filed: Oct. 14, 1999

(65) Prior Publication Data

US 2002/0013095 A1 Jan. 31, 2002

(30) Foreign Application Priority Data

Feb. 25, 1999 (JP) ..... 11-048509

(51) Int. Cl.[7] ..... H01R 13/648
(52) U.S. Cl. ..... 439/608; 439/108
(58) Field of Search ..... 439/101, 108, 439/941, 608, 877

(56) References Cited

U.S. PATENT DOCUMENTS

| | | | | | |
|---|---|---|---|---|---|
| 5,162,001 | A | * | 11/1992 | Harwath et al. | 439/608 |
| 5,507,655 | A | * | 4/1996 | Goerlich | 439/108 |
| 5,525,067 | A | * | 6/1996 | Gatti | 439/108 |
| 5,607,326 | A | * | 3/1997 | McNamara et al. | 439/608 |
| 5,660,551 | A | * | 8/1997 | Sakurai | 439/108 |
| 5,842,887 | A | * | 12/1998 | Andrews | 439/608 |
| 5,957,737 | A | * | 9/1999 | Ozai | 439/877 |

* cited by examiner

*Primary Examiner*—Tho D. Ta
*Assistant Examiner*—Edwin A. León
(74) *Attorney, Agent, or Firm*—Staas & Halsey LLP

(57) ABSTRACT

A connector for an electronic device has a plug with signal contacts and ground contacts arranged in an alternating sequence in two parallel rows. A shield portion is provided on each ground contact so as to cover an area around adjacent signal contacts so as to reduce crosstalk between adjacent signal contacts.

10 Claims, 9 Drawing Sheets

26
52a
52b
50
48
41
52b
52a
52a
52

52
52a
50
41
48
41
26
52a.

26
52b
41
52
50
41

CONNECTOR HAVING A SHIELD FOR SIGNAL CONTACTS

BACKGROUND OF THE INVENTION

1. Field of the Invention

The present invention relates generally to an electronic device connector, and more particularly, to an electronic device connector having a shield for signal contacts.

2. Description of the Related Art

As electronic devices have become more sophisticated the connectors that are connected to these electronic devices have changed as well. Specifically, the pitch between connector terminals has tended to become smaller. At the same time, however, cable assembly involving such small-pitch connectors continues to require the highest accuracy and reliability.

Conventionally, in order to meet this need for accurate and reliable cable assembly involving small-pitch connectors, as shown in FIG. 1B the signal contacts 1*a* through 1*e* and the ground contacts 2 of both the connector plug and connector jack have been arranged in alternate sequence in two parallel rows when seen from the front of the engaging portions of the plug and jack.

According to this method, adjacent signal contacts in the same row, for example signal contacts 1*b* and 1*c* in FIG. 1B, are separated by a ground contact 2. As a result, the shield effect of the ground contact 2 reduces signal leakage between adjacent signal contacts, that is, crosstalk. At the same time, signal contacts 1*d* and 1*e* of the lower row shown in FIG. 1B are disposed so as to be offset one position from signal contacts 1*a*, 1*b* and 1*c* of the upper row shown in FIG. 1B, an arrangement which results in less crosstalk than the disposition shown in FIG. 1A, in which, for example, signal contacts 1*f* of the upper row and 1*g* of the lower row are disposed so as to be adjacent to each other.

SUMMARY OF THE INVENTION

It is a general object of the present invention to provide an improved and useful connector capable of further reducing crosstalk in a connector having a plurality of signal contacts and ground contacts arranged in alternating sequence in two parallel rows, the two rows having opposed sequences such that a signal contact in one row is opposed by a ground contact in the other row and vice versa.

The above-described object of the present invention is achieved by a plug having a plurality of signal contacts and a plurality of ground contacts arranged in alternating sequence in two parallel rows, the two rows having opposed sequences such that a signal contact in one row is opposed by a ground contact in the other row and vice versa, a shield portion being provided on each ground contact.

Additionally, the above-described object of the present invention is also achieved by a plug having a plurality of signal contacts and a plurality of ground contacts arranged in alternating sequence in two parallel rows, the two rows having opposed sequences such that a signal contact in one row is opposed by a ground contact in the other row and vice versa, each ground contact having a jack engaging portion, the jack engaging portion having a size which shields a region opposite signal contacts between which one of the ground contacts is disposed.

According to the plug of the present invention, crosstalk between adjacent signal contacts can be reduced.

Additionally, the above-described object of the present invention is also achieved by a plug having a plurality of signal contacts and a plurality of ground contacts arranged in alternating sequence in two parallel rows, the two rows having opposed sequences such that a signal contact in one row is opposed by a ground contact in the other row and vice versa, a ground shield being extended from a conjoining portion of one of the ground contacts adjacent to a pressure-contacting portion of a respective one of the signal contacts.

According to the plug of the present invention, the ground contacts and signal contacts can be positioned closer to each other, that is, the pitch between connector terminals can be decreased, making it possible to make devices more compact.

Additionally, the above-described object of the present invention is also achieved by a jack having a plurality of signal contacts and a plurality of ground contacts arranged in alternating sequence in two parallel rows, the two rows having opposed sequences such that a signal contact in one row is opposed by a ground contact in the other row and vice versa, a shield portion being provided on each ground contact.

Additionally, the above-described object of the present invention is also achieved by a jack having a plurality of signal contacts and a plurality of ground contacts arranged in alternating sequence in two parallel rows, the two rows having opposed sequences such that a signal contact in one row is opposed by a ground contact in the other row and vice versa, each ground contact having a plug engaging portion, the plug engaging portion having a size which shields a region opposite signal contacts between which one of the ground contacts is disposed.

According to the jack of the present invention, crosstalk between adjacent signal contacts can be reduced.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

A description will now be given of an embodiment of the present invention, with reference to the accompanying drawings.

Figure 1A:
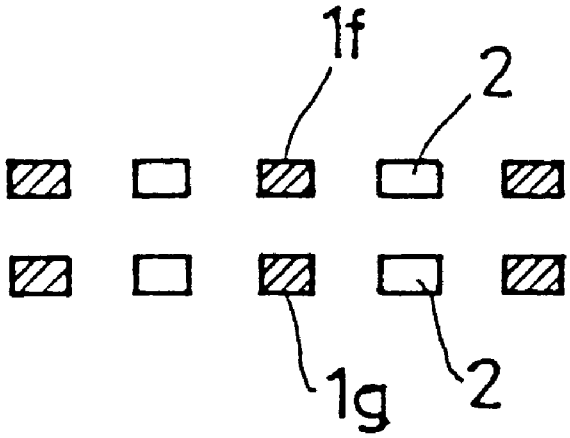
FIG.1A PRIOR ART
FIGS. 1A and 1B are diagrams showing two sets of two rows of ground contacts and signal contacts, one set having an identical alternation of ground contacts and signal contacts and another set having an opposed alternation of ground contacts and signal contacts, such that a signal contact in one row is opposed by a ground contact in the other row and vice versa.
Figure 1B:
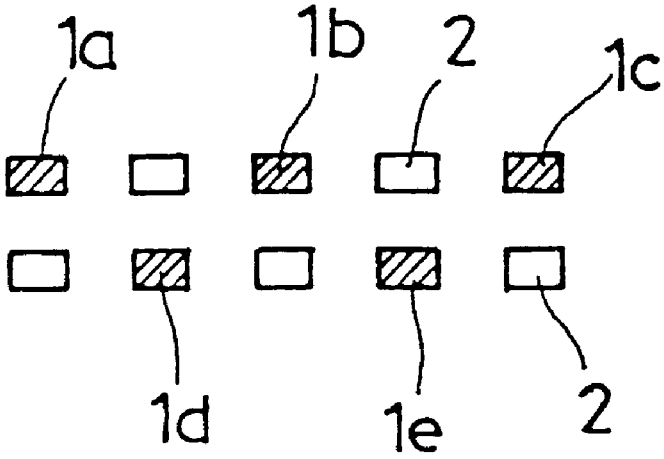
FIG.1B PRIOR ART
Figure 2:
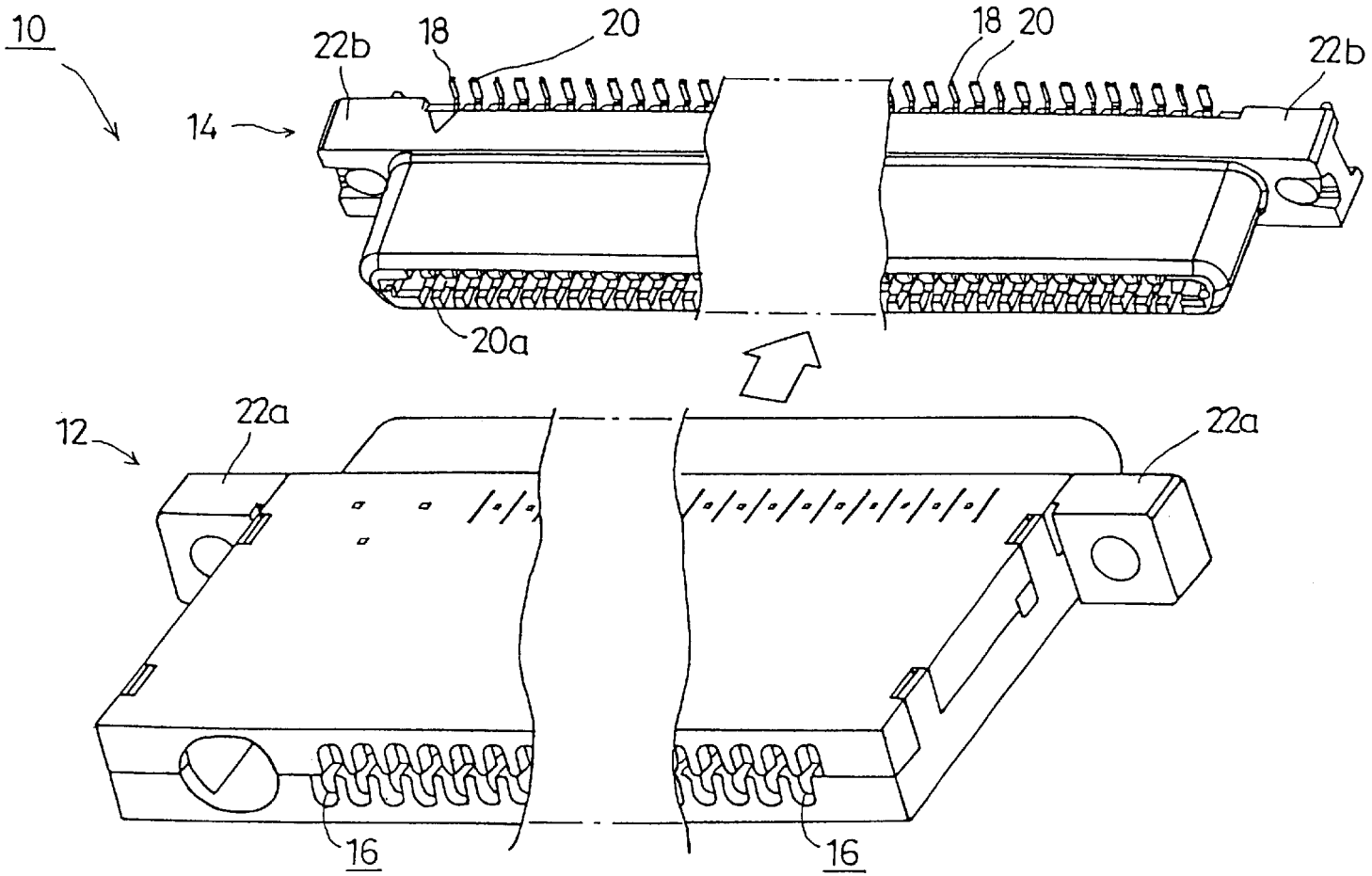
FIG. 2 is a perspective view of a connector according to an embodiment of the present invention.

FIG. 2 is a perspective view of a connector according to an embodiment of the present invention, in which a plug 12 and a jack 14 form the connector 10. A plurality of holes 16 are formed on a near edge of the plug 12. A cable, not shown in the drawing, is attached to the holes 16. A plurality of signal contacts 18 and ground contacts 20 are provided on a far side of the jack 14. Signal contact tips 18 and ground contact tips 20 are soldered to printed circuits on a printed circuit board not shown in the drawing.

The plug 12 and the jack 14 engage between the terminals, in the direction of the arrow shown in FIG. 2. Engaging portions 22*a*, 22*b* on both sides of the plug and the jack, respectively, are fixedly mounted in place by an engaging member not shown in the drawing, completing connection.

Figure 3A:
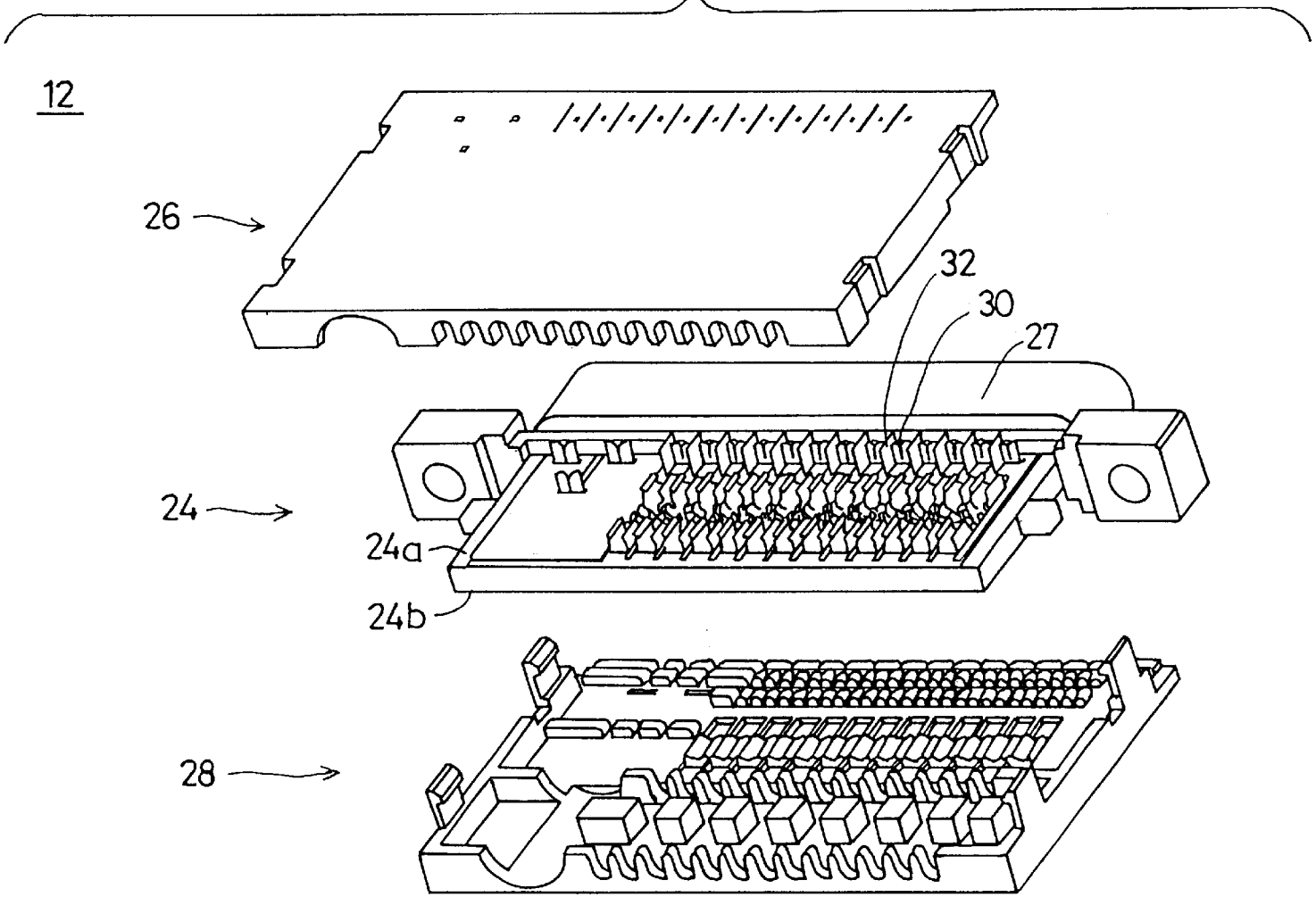
FIGS. 3A and 3B are an exploded perspective view of the connector plug of FIG. 2 and a schematic view of the arrangement of ground contacts and signal contacts as seen from a far side of the connector plug of FIG. 2 as seen in FIG. 3A, respectively.
Figure 3B:
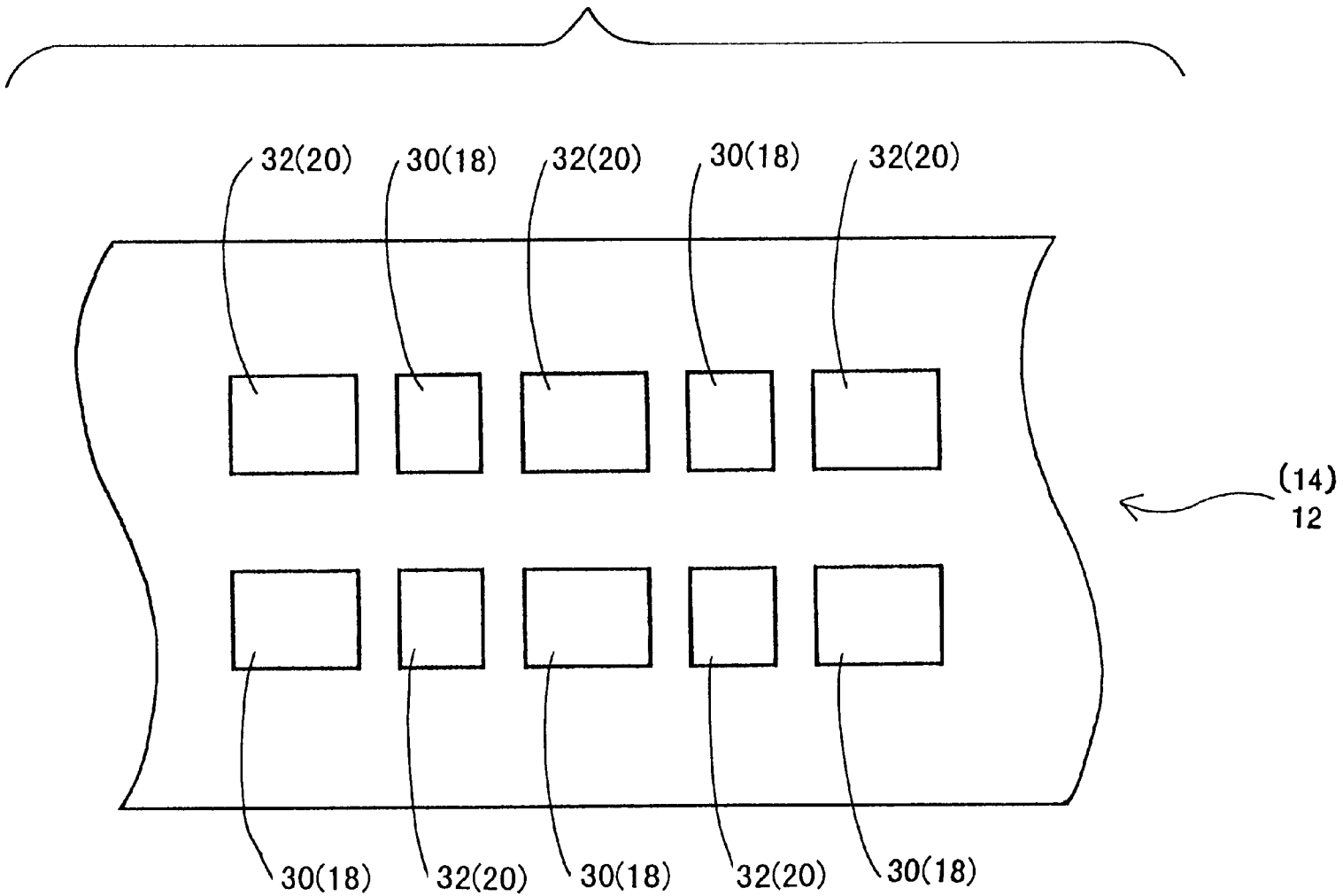

FIG. 3A is an expanded perspective view of the plug 12 shown in FIG. 2. The plug 12 comprises a plug insulator 24, a plug case 27, an upper cover 26 and a lower cover 28. Signal contacts 30 of the plug 12 and ground contacts 32 of the plug 12 are arranged in alternating sequence on both an upper surface 24*a* and a lower surface 24*b* of the plug insulator 24. It should be noted that the lower surface 24*b* of the plug insulator 24 is not shown in the diagram but nevertheless has the same structure as the upper surface 24*a*, the two surfaces 24*a* and 24*b* thus having identical structures formed symmetrically with respect to the plug insulator 24 central plastic layer portion. The signal contacts 30 of the plug 12 as well as ground contacts 32 of the plug 12 are arranged in alternating sequence in two parallel rows, the two rows having opposed sequences such that a signal contact in one row is opposed by a ground contact in the other row and vice versa, on the upper and lower surfaces 24*a* and 24*b*.

It should be noted that, like the plug 12, the jack 14 also has signal contacts 18 and ground contacts 20 arranged in alternating sequence in two parallel rows, the two rows having opposed sequences such that a signal contact in one row is opposed by a ground contact in the other row and vice versa.

Figure 4B:
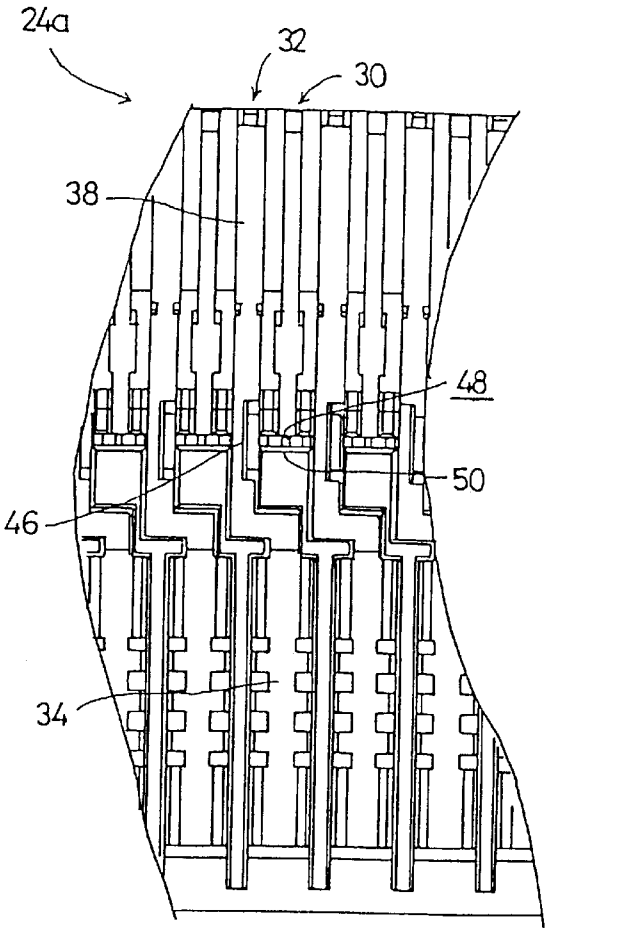
FIGS. 4A and 4B are diagrams showing partial perspective and plan views, respectively, of a top surface of a plug insulator.
Figure 4A:
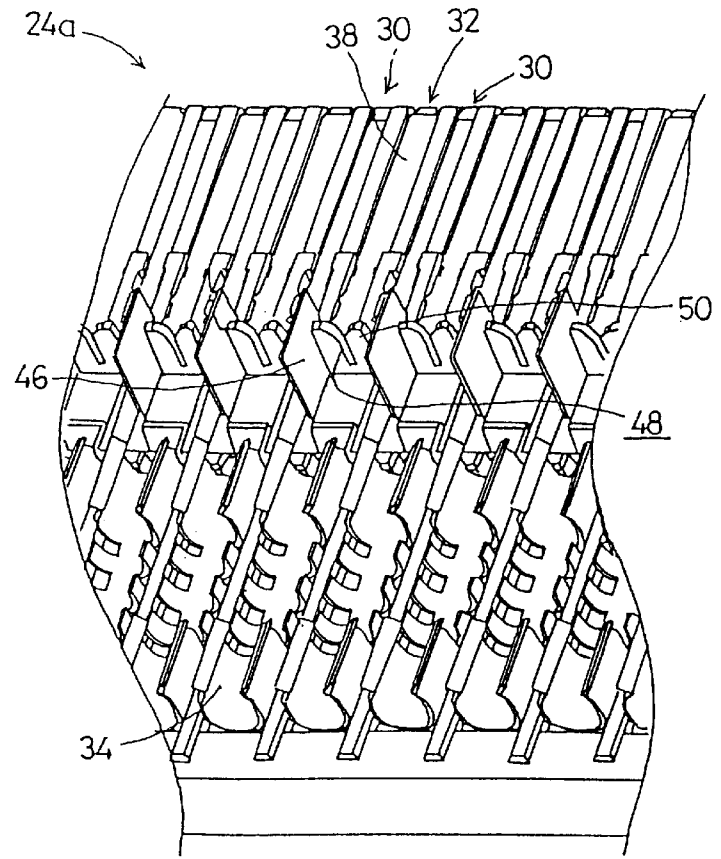

FIG. 4A shows a partial expanded perspective view of the upper surface 24*a* of the plug insulator 24 shown in FIG. 3A and FIG. 4B shows a partial expanded plan view of the upper surface 24*a* of the plug insulator 24. Additionally, FIG. 5 shows a perspective view of the ground contact 32 of the plug 12.

The ground contact 32 is formed using electrically conductive metallic material, and comprises a cable engaging portion 34, a conjoining portion 36 disposed adjacent to a signal contact pressure-contacting portion 50 to be described later, and a jack engaging portion 38. The cable engaging portion 34 is formed so that both sides arc upward to form an elongated section substantially U-shaped in cross-section. A plurality of notches are cut into the cable engaging portion 34, essentially forming the cable engaging portion 34 into a plurality of symmetrical prongs. Either a protective rubber sheath portion 42 or a metallic mesh shield portion 44 of a cable 40 is inserted into this elongated U-shaped cable engaging portion 34 and the prongs are then closed around that portion of the cable 40 so inserted.

Figures 5A, 5B, 5C:
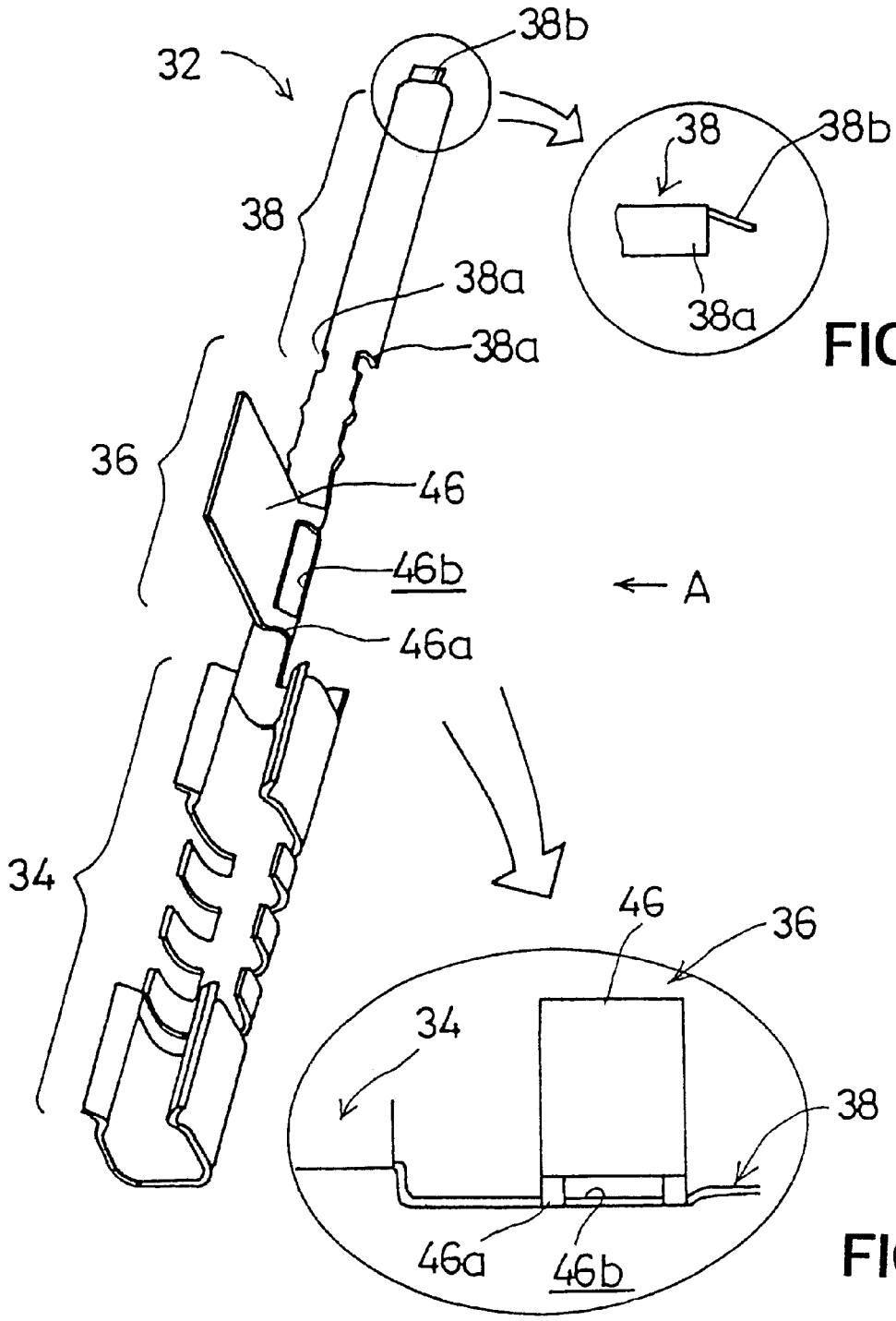
FIG. 5B is an enlarged view of the jack engaging portion of FIG. 5A.
FIG. 5C is an enlarged view of the ground shield of FIG. 5A.

A substantially rectangular ground shield 46 is formed on the conjoining portion 36 disposed adjacent to the pressure-contacting portion 50 of the signal contact, the ground shield 46 being of a fixed uniform width along the longitudinal dimension of the ground contact 32 and bent upward in a semicircular arc section 46*c* from the conjoining portion so as to be disposed at essentially a right angle to the longitudinal axis of the ground contact 32. This semicircular are section 46*a* is further provided with a longitudinal slit 46*b* as indicated in FIG. 5C. The entire conjoining portion 36 is lowered slightly below the longitudinal axis of the ground contact 32, as indicated in FIG. 5A.

Sides 38*a* of the jack engaging portion 38 of the ground contact 32 are bent downward in an arc to form substantially an inverted U shape in cross-section, with the tip 38*b* of the jack engaging portion 38 bent downward as indicated in FIGS. 5A and 5B.

The shape of the ground contact 32 as described above is such that, as shown in FIG. 4A, the signal contact pressure-contacting portion 50 of the signal contact 30, having a substantially V-shaped aperture 48 formed thereon, can be positioned adjacent to the vicinity of the ground shield 46 of the ground contact 32, and, accordingly, the distance between the signal contact 30 and the ground contact 32, that is, the pitch between terminals, can be decreased. The core 41 of the cable 40 engages the aperture 48 of the signal contact pressure-contacting portion 50 with the cable 40 and core 41 in essentially a straight, unbent condition.

Additionally, crosstalk is reduced because the ground shield 46 of the ground contact 32 is disposed so as to shield that portion of the upper surface 24*a* of the plug insulator 24 opposite an area between adjacent signal contacts 30, 30.

Additionally, because the sides 38*a* of the jack engaging portion 38 of the ground contact 32 are bent downward in an arc to form substantially an inverted U shape in cross-section as described above, when the plug 12 engages the jack 14 the forward tip 20*a* of the ground contact 20 of the jack 14 can be inserted smoothly into the ground contact 32 of the plug 12, thus preventing, for example, detachment of any plating formed on the surface of the ground contact 32.

Figure 6A:
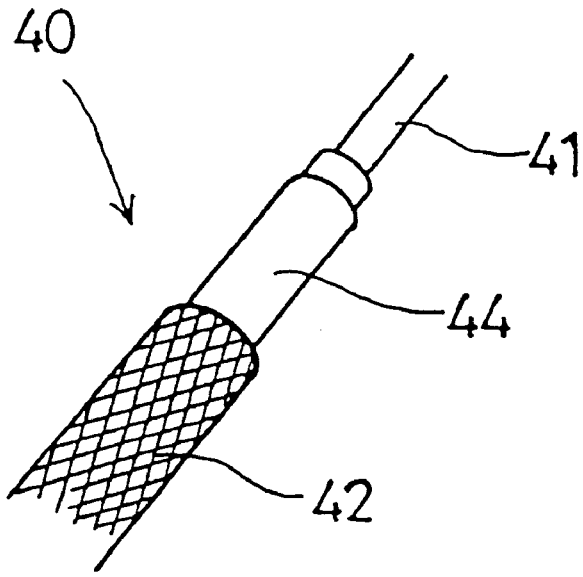
FIGS. 6A and 6B are diagrams showing an ordinary cable and a cable according to the embodiment of the present invention, respectively.
Figure 6B:
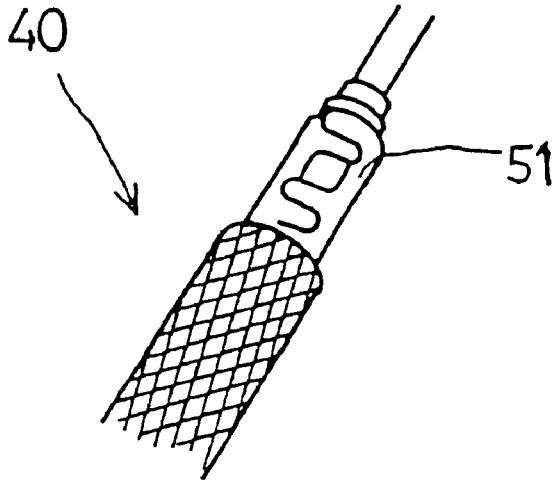

It should be noted that the cable 40 may have a structure shown in FIG. 6B instead of a structure shown in FIG. 6A. In the structure shown in FIG. 6B, the end of the shield portion 44 is covered by a metal portion 51 so as to prevent the metallic mesh from being separated from the shield portion 44.

It should be noted that an aperture. 52 is formed in the upper cover 26 shown in FIG. 34 for the purpose of inserting the signal contact pressure-contacting section 50. However, instead of the conventional aperture in which the entire periphery of the opening is tapered toward the interior of the aperture 52 to form a tapered portion 52*a*, an opening may be used in which no tapered portion 52*a* is formed on a side wall portion 52*b* of the opening perpendicular to the core 41 of the cable 40 as shown in FIG. 7A.

Figures 7A, 7B, 7C:
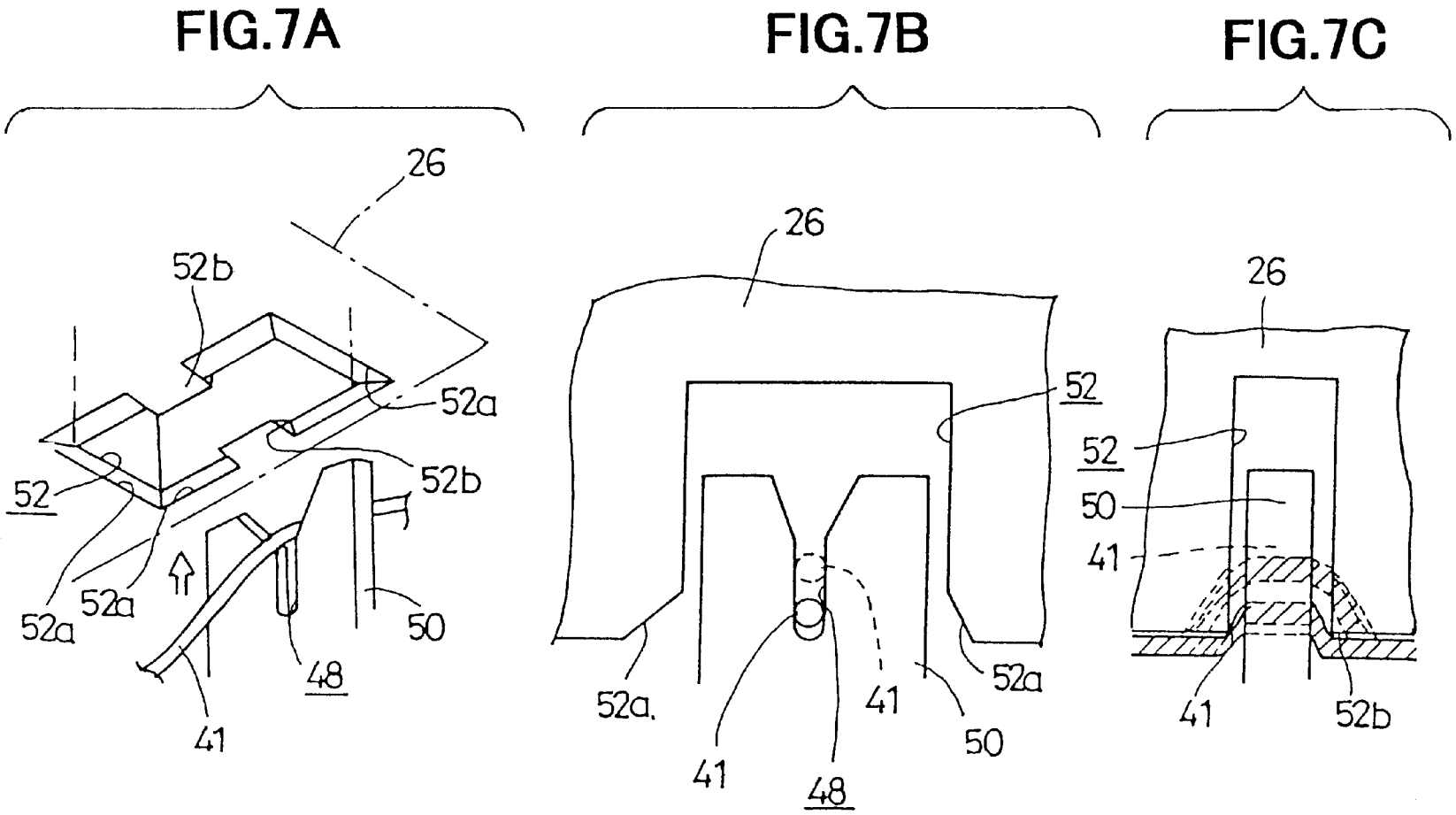
FIGS. 7A, 7B and 7C are diagrams showing partial perspective, partial front cross-sectional and partial side cross-sectional views of a top cover and signal connector pressure-connection portion.

According to the configuration described above, the core 41 of the cable 40 is engaged by the aperture 48 of the signal contact pressure-contacting section 50 so that, when the signal contact pressure-contacting section 50 is inserted into the aperture 52, the core 41 of the cable 40 is not inserted so deeply into the aperture 52 by the tapered portion 52*a* so as to bend like the core 41 of the conventional cable 40 indicated by the dotted lines in FIG. 7B and FIG. 7C. Instead, the cable 40 and core 41 engaged near the bottom of the aperture 48 of the signal contact pressure-contacting portion 50 in essentially a straight, unbent condition. As a result, the walls of the aperture 48 of the signal contact pressure-contacting section 50 are able to remove the cover insulation from the core 41, which has been engaged with the cover insulation still intact, thus providing an improved electrical connection between the signal contact 30 and the core 41.

It should be noted that the lower cover 28 can be made to have the same structure as the upper cover 26 described above.

Figure 8:
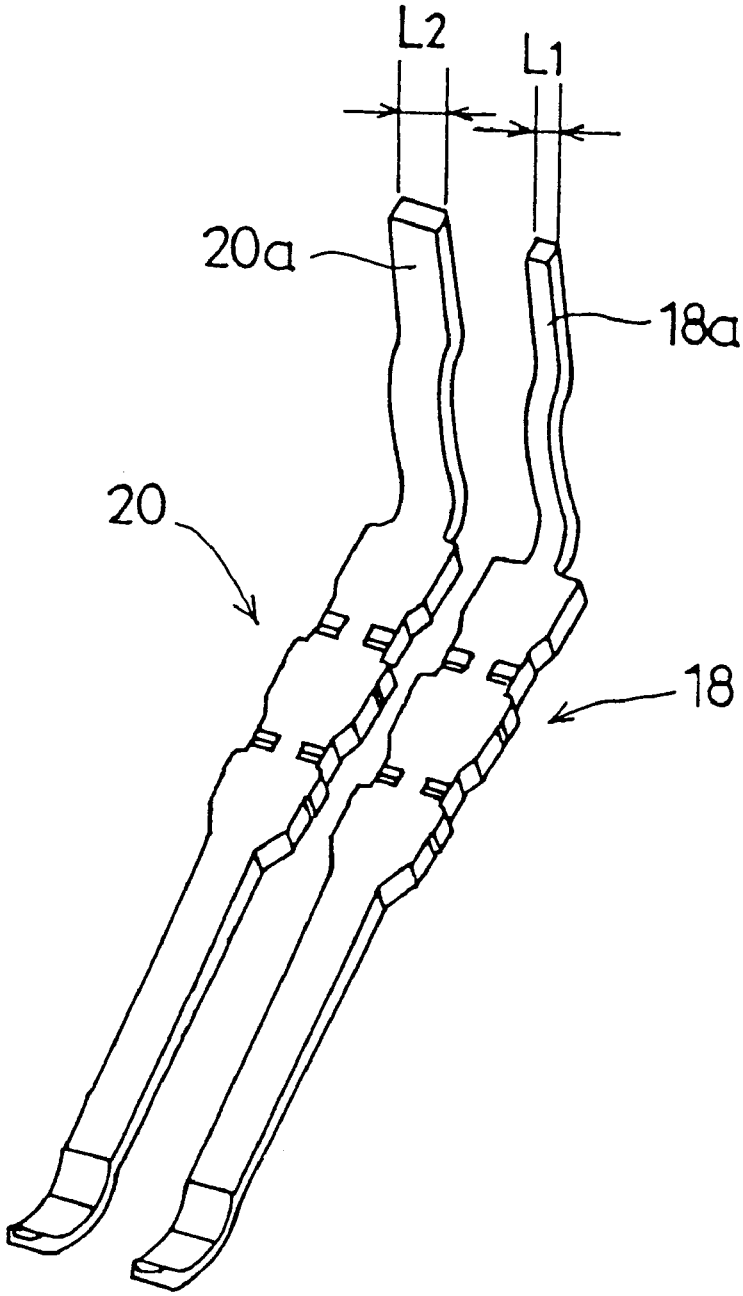
FIG. 8 is a perspective view of the signal contacts and ground contacts of the jack according to the embodiment of the present invention.

Next, FIG. 8 is a diagram showing a perspective schematic view of the signal contacts 18 and ground contacts 20 of the jack 14 shown in FIG. 2 according to an embodiment of the present invention. As can be appreciated from the drawing, the width L2 of a tip 20*a* of a ground contact 20 bent upward is greater than a width L1 of a tip 18*a* of a signal contact 18 bent upward. As a result of this enlargement of the width L2 of the tip 20*a* of the ground contact 20, crosstalk can be reduced to a greater extent than would be possible with ground contacts having a narrower width, for example, a width identical to the width L1 of tip 18*a* of the signal contact 18.

The above description is provided in order to enable any person skilled in the art to make and use the invention and sets forth the best mode contemplated by the inventors of carrying out the invention.

The present invention is not limited to the specifically disclosed embodiment, and variations and modifications may be made without departing from the scope of the present invention.

The present application is based on Japanese Priority Application No. 11-048509, filed on Feb. 25, 1999, the entire contents of which are hereby incorporated by reference.

What is claimed is:

1. A plug having a plurality of signal contacts and a plurality of ground contacts arranged in alternating sequence in two parallel rows, the two rows having opposed sequences such that a signal contact in one row is opposed by a ground contact in the other row and vice versa, a shield portion being provided on each ground contact, wherein each of the signal contacts is made of an elongated, electrically conductive metallic material including an engaging portion on one end thereof and a pressure-contacting portion in the middle thereof, the engaging portion being configured to make a contact with an engaging portion of a signal contact provided in a jack, the pressure-contacting portion being configured to make a contact with a core conductive member of a cable;

each of the ground contacts is made of an elongated, electrically conductive metallic material including an engaging portion on one end thereof and a cable engaging portion on the other end thereof, the engaging portion being configured to make a contact with an engaging portion of a ground contact of the jack, the cable engaging portion being configured to be connected to a conductive portion surrounding the core conductive member of said cable so as to support said cable;

the signal contacts of the plug and the ground contacts of the plug are arranged parallel to each other and in alternating sequence on both an upper surface and a lower surface of a plug insulator such that a signal contact on one side of the plug insulator is opposed by a ground contact on the other side of the plug insulator and vice versa; and an upper cover is provided on the upper side of the plug insulator with the signal contacts and the ground contacts therebetween and a lower cover is provided on the lower side of the plug insulator with the signal contacts and the ground contacts therebetween, wherein the shield portion is formed on a conjoining portion of said ground contact, said shield portion comprising a semicircular arc section disposed substantially perpendicular to a longitudinal axis of said ground contact, said semicircular arc section defining a slit substantially parallel to the longitudinal axis of said ground contact.

2. The plug as claimed in claim 1, wherein each of the signal contacts has a conjoining portion extending from the pressure-contacting portion, and the conjoining portion is disposed between the cable engaging portions of adjacent ground contacts.

3. The plug as claimed in claim 1, wherein each of the signal contacts and the ground contacts has a bent portion in the middle thereof so that the pressure-contacting portion of one of the signal contacts and the cable engaging portion of the ground contacts adjacent to the one of the signal contacts aligns with each other along the longitudinal direction of the ground contacts.

4. A plug having a plurality of signal contacts and a plurality of ground contacts arranged in alternating sequence in two parallel rows, the two rows having opposed sequences such that a signal contact in one row is opposed by a ground contact in the other row and vice versa, each ground contact having a jack engaging portion, the jack engaging portion having a size which shields a region opposite signal contacts between which one of the ground contacts is disposed, wherein each of the signal contacts is made of an elongated, electrically conductive metallic material including an engaging portion on one end thereof and a pressure-contacting portion in the middle thereof, the engaging portion being configured to make a contact with an engaging portion of a signal contact provided in a jack, the pressure-contacting portion being configured to make a contact with a core conductive member of a cable:

each of the ground contacts is made of an elongated, electrically conductive metallic material including an engaging portion on one end thereof and a cable engaging portion on the other end thereof, the engaging portion being configured to make a contact with an engaging portion of a ground contact of the jack, the cable engaging portion being configured to be connected to a conductive portion surrounding the core conductive member of said cable so as to support said cable;

the signal contacts of the plug and the ground contacts of the plug are arranged parallel to each other and in alternating sequence on both an upper surface and a lower surface of a plug insulator such that a signal contact on one side of the plug insulator is opposed by a ground contact on the other side of the plug insulator and vice versa, each of the ground contacts having a width greater than a width of each of the signal contacts; and an upper cover is provided on the upper side of the plug insulator with the signal contacts and the ground contacts therebetween and a lower cover is provided on the lower side of the plug insulator with the signal contacts and the ground contacts therebetween.

5. A plug having a plurality of signal contacts and a plurality of ground contacts arranged in alternating sequence in two parallel rows, the two rows having opposed sequences such that a signal contact in one row is opposed by a ground contact in the other row and vice versa, a ground shield being extended from a conjoining portion of one of the ground contacts adjacent to a pressure-contacting portion of a respective one of the signal contacts, wherein each of the signal contacts is made of an elongated, electrically conductive metallic material including an engaging portion on one end thereof and a pressure-contacting portion in the middle thereof, the engaging portion being configured to make a contact with an engaging portion of a signal contact provided in a jack, the pressure-contacting portion being configured to make a contact with a core conductive member of a cable by extending in a direction perpendicular to a longitudinal direction of the signal contact and having a slit to which the core conductive member of the cable is connected;

each of the ground contacts is made of an elongated, electrically conductive metallic material including an engaging portion on one end thereof and a cable engaging portion on the other end thereof, the engaging portion being configured to make a contact with an engaging portion of a ground contact of the jack, the cable engaging portion being configured to be connected to a conductive portion surrounding the core conductive member of said cable so as to support said cable;

the signal contacts of the plug and the ground contacts of the plug are arranged parallel to each other and in alternating sequence on both an upper surface and a lower surface of a plug insulator such that a signal contact on one side of the plug insulator is opposed by a ground contact on the other side of the plug insulator and vice versa; and an upper cover is provided on the upper side of the plug insulator with the signal contacts and the ground contacts therebetween and a lower cover is provided on the lower side of the plug insulator with the signal contacts and the ground contacts therebetween.

6. A jack having a plurality of signal contacts and a plurality of ground contacts arranged in alternating sequence in two parallel rows, the two rows having opposed sequences such that a signal contact in one row is opposed by a ground contact in the other row and vice versa, a shield portion being provided on each ground contact, wherein each of the signal contacts is made of an elongated, electrically conductive metallic material including an engaging portion on one end thereof and an external connection terminal on the other end thereof, the engaging portion being configured to make a contact with an engaging portion of a signal contact of a plug;

each of the ground contacts is made of an elongated, electrically conductive metallic material including an engaging portion on one end thereof and an external connection terminal on the other end thereof, the engaging portion being configured to make a contact with an engaging portion of a ground contact of the plug; and the signal contacts of the jack and the ground contacts of the jack are arranged parallel to each other and in alternating sequence on both an upper inner surface and a lower inner surface of an insertion opening of a jack insulator such that a signal contact on one side of the insertion opening is opposed by a ground contact on the other side of the insertion opening and vice versa, the insertion opening of the jack insulator being configured to accept a portion of the plug, the external connection terminals of the signal contacts and the ground contacts of the jack being extended from the jack insulator on a side opposite to the insertion opening, wherein the shield portion is formed on a conjoining portion of said ground contact, said shield portion comprising a semicircular are section disposed substantially perpendicular to a longitudinal axis of said ground contact, said semicircular arc section defining a slit substantially parallel to the longitudinal axis of said ground contact.

7. A jack having a plurality of signal contacts and a plurality of ground contacts arranged in alternating sequence in two parallel rows, the two rows having opposed sequences such that a signal contact in one row is opposed by a ground contact in the other row and vice versa, each ground contact having a plug engaging portion, the plug engaging portion having a size which shields a region opposite signal contacts between which one of the ground contact is disposed, wherein each of the signal contacts is made of an elongated, electrically conductive metallic material including an engaging portion on one end thereof and an external connection terminal on the other end thereof, the engaging portion being configured to make a contact with an engaging portion of a signal contact of a plug:

each of the ground contacts is made of an elongated, electrically conductive metallic material including an engaging portion on one end thereof and an external connection terminal on the other end thereof, the engaging portion being configured to make a contact with an engaging portion of a ground contact of the plug; and the signal contacts of the jack and the ground contacts of the jack are arranged parallel to each other and in alternating sequence on both an upper inner surface and a lower inner surface of an insertion opening of a jack insulator such that a signal contact on one side of the insertion opening is opposed by a ground contact on the other side of the insertion opening and vice versa, the insertion opening of the jack insulator being configured to accept a portion of the plug, the external connection terminals of the signal contacts and the ground contacts of the jack being extended from the jack insulator on a side opposite to the insertion opening.

8. A connector comprising:

a jack; and a plug engageable with said jack, said plug having a plurality of signal contacts and a plurality of ground contacts arranged in alternating sequence in two parallel rows, the two rows having opposed sequences such that a signal contact in one row is opposed by a ground contact in the other row and vice versa, each ground contact having a jack engaging portion, the jack engaging portion having a size which shields a region opposite signal contacts between which one of the ground contacts is disposed, wherein each of the signal contacts is made of an elongated, electrically conductive metallic material including an engaging portion on one end thereof and a pressure-contacting portion in the middle thereof, the engaging portion being configured to make a contact with an engaging portion of a signal contact provided in said jack, the pressure-contacting portion being configured to make a contact with a core conductive member of a cable;

each of the ground contacts is made of an elongated, electrically conductive metallic material including an engaging portion on one end thereof and a cable engaging portion on the other end thereof, the engaging portion being configured to make a contact with an engaging portion of a ground contact of said jack, the cable engaging portion being configured to be connected to a conductive portion surrounding the core conductive member of the cable so as to support the cable:

the signal contacts of the plug and the ground contacts of the plug are arranged parallel to each other and in alternating sequence on both an upper surface and a lower surface of a plug insulator such that a signal contact on one side of the plug insulator is opposed by a ground contact on the other side of the plug insulator and vice versa; and an upper cover is provided on the upper side of the plug insulator with the signal contacts and the ground contacts therebetween and a lower cover is provided on the lower side of the plug insulator with the signal contacts and the ground contacts therebetween.

9. A connector comprising:

a plug; and a jack engageable with said plug, said jack having a plurality of signal contacts and a plurality of ground contacts arranged in alternating sequence in two parallel rows, the two rows having opposed sequences such that a signal contact in one row is opposed by a ground contact in the other row is opposed by a ground contact in the other row and vice versa, each ground contact having a plug engaging portion, the plug engaging portion having a size which shields a region opposite signal contacts between which one of the ground contact is disposed, wherein each of the signal contacts is made of an elongated, electrically conductive metallic material including an engaging portion on one end thereof and an external connection terminal on the other end thereof, the engaging portion being configured to make a contact with an engaging portion of a signal contact of said plug;

each of the ground contacts is made of an elongated, electrically conductive metallic material including an engaging portion on one end thereof and an external connection terminal on the other end thereof, the engaging portion being configured to make a contact with an engaging portion of a ground contact of said plug; and the signal contacts of the jack and the ground contacts of the jack are arranged parallel to each other and in alternating sequence on both an upper inner surface and a lower inner surface of an insertion opening of a jack insulator such that a signal contact on one side of the insertion opening is opposed by a ground contact on the other side of the insertion opening and vice versa, the insertion opening of the jack insulator being configured to accept a portion of said plug, the external connection terminals of the signal contacts and the ground contacts of the jack being extended from the jack insulator on a side opposite to the insertion opening.

10. A plug comprising:

a plurality of signal contacts, each of said plurality of signal contacts comprising a first engaging portion and a pressure contacting portion spaced from the first engaging portion; and a plurality of ground contacts arranged in alternating sequence with said plurality of signal contacts, a shield portion being provided on each ground contact, each of said plurality of ground contacts comprising a second engaging portion and a cable engaging portion spaced from the second engaging portion;

the signal contacts of the plug and the ground contacts of the plug are arranged on both an upper surface and a lower surface of a plug insulator.

* * * * *